US006615621B1

(12) United States Patent
Stupecky

(10) Patent No.: US 6,615,621 B1
(45) Date of Patent: Sep. 9, 2003

(54) DEVICE FOR FLESHING, STRETCHING AND DRYING LEATHER OR SIMILAR FLAT MATERIALS SUCH AS SKINS, FURS AND SUCH LIKE

(76) Inventor: Bohumil Stupecky, Zum Nussbaum 6, Mertesdorf (DE), D-54318

( * ) Notice: Subject to any disclaimer, the term of this patent is extended or adjusted under 35 U.S.C. 154(b) by 0 days.

(21) Appl. No.: 09/719,760

(22) PCT Filed: Jun. 2, 1999

(86) PCT No.: PCT/DE99/01636

§ 371 (c)(1),
(2), (4) Date: Mar. 9, 2001

(87) PCT Pub. No.: WO99/66081

PCT Pub. Date: Dec. 23, 1999

(30) Foreign Application Priority Data

Jun. 14, 1998 (DE) ..... 198 26 181

(51) Int. Cl.[7] ..... C14B 1/26
(52) U.S. Cl. ..... 69/19.1; 69/19
(58) Field of Search ..... 69/19.1, 29, 32, 69/48, 19, 19.2; 34/266; 26/51; 38/12, 17, 18, 102

(56) References Cited

U.S. PATENT DOCUMENTS 4,202,190 A * 5/1980 Viljanmaa ..... 69/19.3
4,335,594 A * 6/1982 Viljanmaa ..... 69/19.3
4,438,570 A * 3/1984 Dokoupil ..... 34/266
4,487,041 A * 12/1984 duBourg ..... 69/1
5,291,759 A * 3/1994 Dokoupil ..... 69/19.1

FOREIGN PATENT DOCUMENTS

DE 19826181 * 12/1999 ..... C14B/1/26
FR 2602795 * 8/1986 ..... C14B/1/40

* cited by examiner

*Primary Examiner*—Gary L. Welch
(74) *Attorney, Agent, or Firm*—Smith, Gambrell & Russell LLP

(57) ABSTRACT

The invention relates to a device for fleshing, stretching and drying leather or similar flat materials such as skins and furs. The device consists of movable lamellae which can be extended from the center outwards and which under vacuum and the cooperation of a pressing device provides a smooth, gliding heatable contact surface on which the stretched and fixed piece of leather is simultaneously dried thereby minimizing any frictional forces encountered when stretching leather in a vacuum. Moisture is evacuated through channels, raised areas, perforations in one of the lamellae thereby improving the stretching effect and uniformity of the stretched leather across its entire surface without wrinkling.

19 Claims, 2 Drawing Sheets

DEVICE FOR FLESHING, STRETCHING AND DRYING LEATHER OR SIMILAR FLAT MATERIALS SUCH AS SKINS, FURS AND SUCH LIKE

BACKGROUND OF THE INVENTION

The invention pertains to a device for the slicking, stretching and drying of leather or similar flat materials such as hides, skins and the like.

It is known from DE 30.10.003 how pieces of leather, pressed together by a vacuum in the interstice between two elastically extensible foils, can be stretched by extending these foils simultaneously.

A device, representing the next state of the art, is known from DE 38.33.068, in which pieces of leather are stretched in the interstice between a low friction support surface and an elastically extensible membrane under vacuum. As opposed to the device according to DE 30.10.003, the employment of a rigid support surface of material with high thermal conductivity permits use as a combined stretching and drying machine, the moisture evaporating from the leather being drained through a relief structure on the membrane, which is connected with a suction device.

The primary disadvantage of this device is that, in spite of the low friction support surface, the contact pressure forces on the leather act against the stretching force. The resistance (friction) thus caused prevents optimum pick-up of the leather and uniform stretching of its whole area, limiting the dimensional increase which can be achieved. In the process, there is great strain on the elastic membrane. Its resulting limited service life lends to increased running costs for the machine. Furthermore, this device is only suitable for the treatment of skins with a low water content (approx. 25%) and is unsuitable for very wet leather.

Vacuum drier units are also known which can also dry very wet leather. The slicking out of surplus water here is carried out manually. However, here the leather is only dried, not simultaneously stretched; in fact, it actually shrinks.

SUMMARY OF THE INVENTION

The function of the invention is the creation of a device which eliminates the high friction forces during stretching of the leather under vacuum in that the leather support surface is formed of elements which carry with them the whole surface of the leather and the contact pressure device without friction resistance to the support surface, resulting in optimum area enlargement, and is also able to stretch and dry very wet leather simultaneously and, if necessary, to slick it out first.

This problem is solved in the invention in that, over a smooth, low friction, heatable support surface, moveable lamellae are fitted, which are connected with a drive mechanism to deploy them outwards from the centre. These lamellae form the actual stretching mechanism, while the primary function of the stacked contact pressure device, consisting of a sheet of extensible material with channels, nubs; perforations and the like for drainage of the moisture from the leather, is fixation. The contact pressure device may also consist of a rigid, inextensible plate, the surface of which is provided with channels, perforations and the like for drainage of moisture from the leather. On this, a second mirror-image lamella system is mounted, so that the leather is stretched between the two outwards deployable lamella systems and is fixed by the rigid contact pressure plate.

BRIEF DESCRIPTION OF THE DRAWINGS

In the following, versions of the device constituting the invention arc explained with the help of drawings.

These show.

DETAILED DESCRIPTION OF THE PREFERRED EMBODIMENTS

Figure 1:
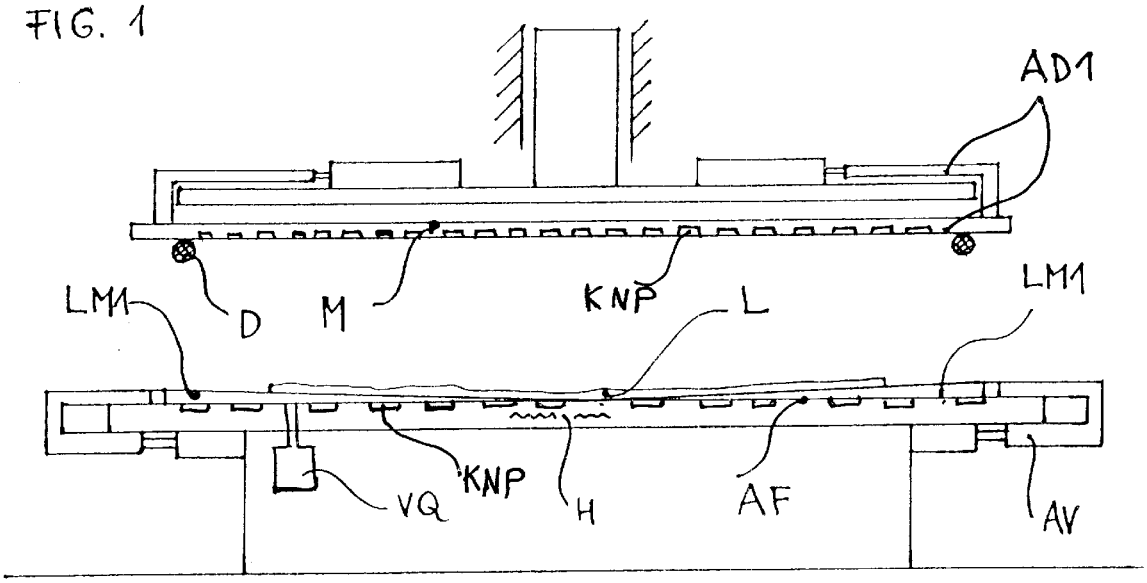
FIG. 1—a complete side view of the device according to Patent claim 1.

The device illustrated in FIG. 1 works with a lamella system (LM1) mounted on the support surface (AF), above which a contact pressure and stretching device consisting of a stretchable membrane (M) is mounted. The leather piece (L) is laid on the lamellae (LM1) of the support surface (AF). By means of a vertical movement, the two parts are moved together and the space between them is sealed by a gasket (D) at the edge of the stretchable membrane (M) or the support surface (AF). The interstitial space, which is connected to a vacuum source (VQ), is evacuated. At the same time, the lamellae (LM1) are deployed, for example through a circular motion around a fixed pin (FB as shown in FIG. 3) by means of a drive device (AV), which may be mechanical, hydraulic or pneumatic, and carry with them the leather piece (L) laid on them.

Figure 2:
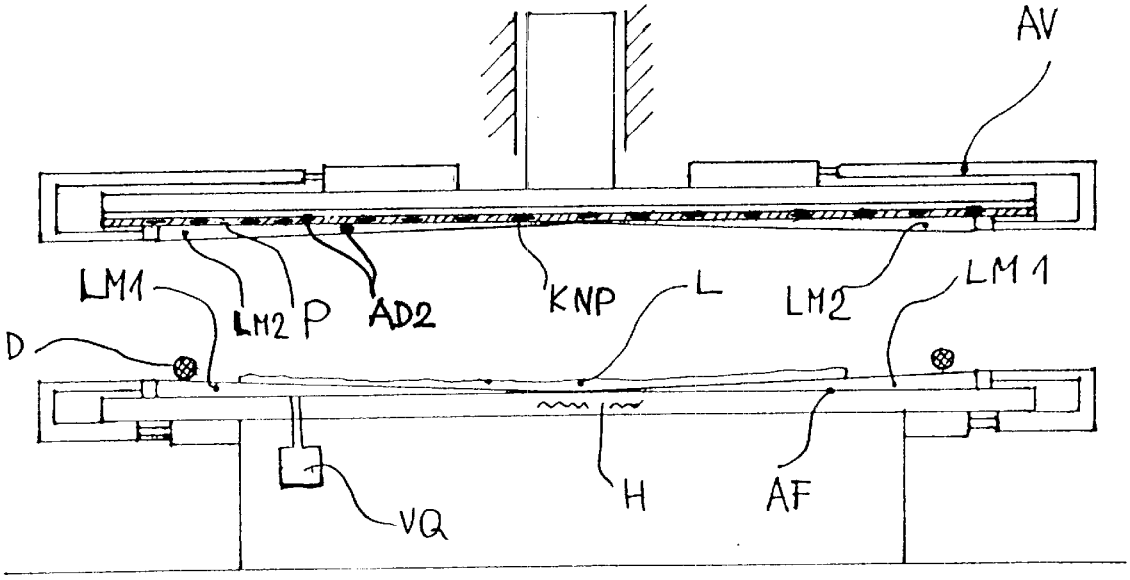
FIG. 2—a complete side view of the device according to Patent claim 2.

In this way, the surplus water is slicked out, creases are smoothed and the surface is uniformly stretched. Channels, nubs, and perforations are designated by KNP in FIGS. 1 and 2. The contact pressure device (AD) formed by the stretchable membrane (M) partly follows the movement of the lamellae, but is nevertheless moved by its own stretching mechanism. As the lamellae (LM1) deploy, they expose a smooth support surface (AF) of high grade metal, heated by a heater (H). The stretched membrane (M) now continuously fixes the stretched leather piece (L) on the support surface (AF), simultaneously drying it through the heating effect. The moisture generated is drained through channels, nubbed surfaces, perforation and the like, either in the metal plate of the support surface (AF) or in the membrane (M). On completion of the stretching and drying process, the vacuum is released.

Figure 3:
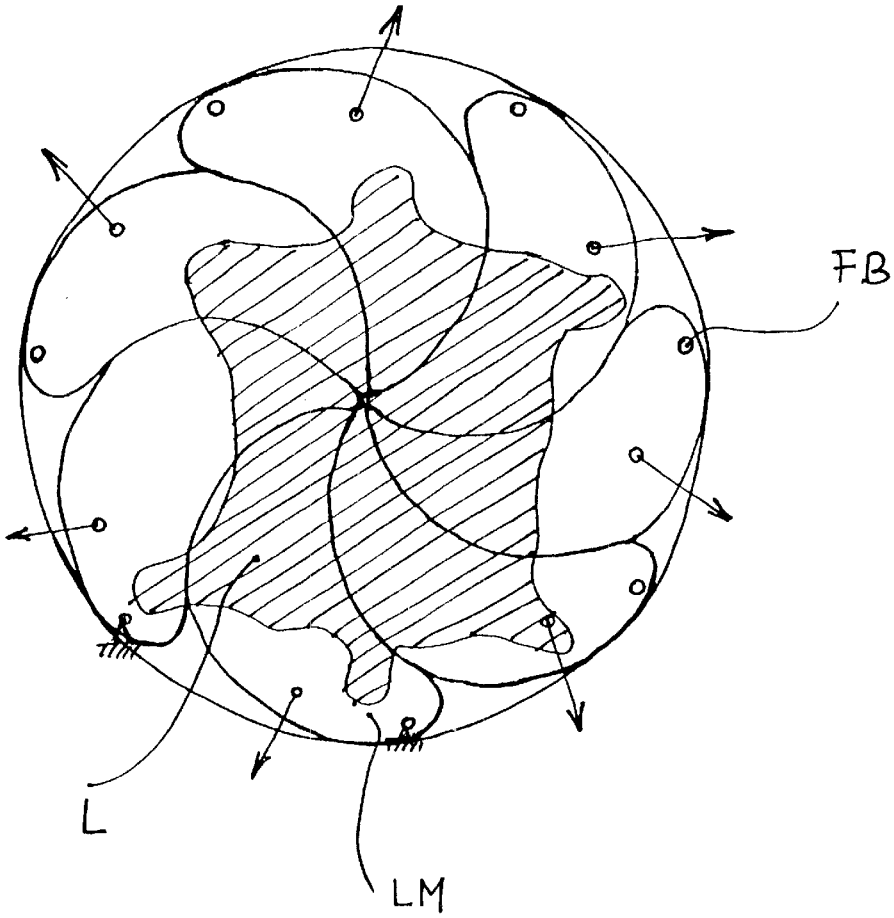
FIG. 3—a plan view of the lamella system loaded with a leather piece, showing the direction or deployment of the lamella outwards from the centre.

FIG. 3 shows a design example of a lamella system LM, indicating the circular motion of the lamellae around a fixed point.

What is claimed is:

1. A device for the dewatering, stretching and drying of leather, similar flat materials and pieces thereof, having an interstice, sealed by a gasket and connected to a vacuum source for the leather piece and consisting of a support surface, above which lamellae are mounted with a drive mechanism to deploy said lamellae outwards from the centre, and a contact pressure device of a stretchable membrane connected to a separate stretching mechanism, whereby the lamellae can be deployed outwards by a circular movement around a fixed pin.

2. The device according to claim 1 wherein the support surface is smooth with low friction, consists of a material with high thermal conductivity and is heated by thermal energy in the form of hot water, oil or another medium.

3. The device according to claim 2 wherein the support surface has channels or perforations to drain the moisture from the leather.

4. The device according to claim 2 wherein the contact pressure device possesses a stretchable membrane, fitted with a stretching mechanism, that presses the leather piece against the lamellae on the support surface.

5. The device according to claim 1 wherein the support surface has channels or perforations to drain the moisture from the leather.

6. The device according to claim 5 wherein the contact pressure device possesses a stretchable membrane, fitted with a stretching mechanism, that presses the leather piece against the lamellae on the support surface.

7. The device according to claim 1 wherein the contact pressure device possesses a stretchable membrane, fitted with a stretching mechanism, that presses the leather piece against the lamellae on the support surface.

8. The device according to claim 1, wherein the stretchable membrane possesses channels, nubs, or perforations for the drainage of moisture from the leather.

9. The device according to claim 1 wherein a rigid, inextensible plate possesses channels, nubs, or perforations for the drainage of moisture from the leather.

10. The device according to claim 1 wherein the movable lamellae present a sliding surface to the support surface and a surface able to move with the leather piece laid on it.

11. The device according to claim 1 wherein the support surface is smooth with low friction, consists of a material with high thermal conductivity and is heated by thermal energy in the form of hot water, oil or another medium.

12. The device according to claim 11 wherein the support surface has channels or perforations to drain the moisture from the leather.

13. The device according to claim 11 wherein the contact pressure device possesses a stretchable membrane, fitted with a stretching mechanism, that presses the leather piece against the lamellae on the support surface.

14. The device according to claims 1 wherein the support surface has channels or perforations to drain the moisture from the leather.

15. The device according to claim 1 wherein the moveable lamellae present a sliding surface to the support surface and a surface able to move with the leather piece laid on it.

16. The device according to claim 1 wherein the drive mechanism for the deployment of the lamellae systems is of mechanical, hydraulic or pneumatic design.

17. The device according to claim 1 wherein the drive mechanism for the deployment of the lamellae systems is of mechanical, hydraulic or pneumatic design.

18. A device for the dewatering, stretching and drying of leather, similar flat materials and pieces thereof, having an interstice, sealed by a gasket and connected to a vacuum source for the leather piece and consisting of a support surface, above which lamellae are mounted with a drive mechanism to deploy said lamellae outwards from the center, and a contact pressure device of a stretchable membrane connected to a separate stretching mechanism, whereby the lamellae can be deployed outwards by a circular movement around a fixed pin wherein the support surface is smooth with low friction, consists of a material with high thermal conductivity and is heated by thermal energy in the form of hot water, oil or another medium wherein the stretchable membrane possesses channels, nubs, perforations and the like for the drainage of moisture from the leather.

19. A device for the dewatering, stretching and drying of leather, similar flat materials and pieces thereof, having an interstice, sealed by a gasket and connected to a vacuum source for the leather piece and consisting of a support surface, above which lamellae are mounted with a drive mechanism to deploy said lamellae outwards from the center, and a contact pressure device of a stretchable membrane connected to a separate stretching mechanism, whereby the lamellae can be deployed outwards by a circular movement around a fixed pin wherein the contact pressure device possesses a stretchable membrane, fitted with a stretching mechanism, that presses the leather piece against the lamellae on the support surface wherein the stretchable membrane possesses channels, nubs, perforations and the like for the drainage of moisture from the leather.

* * * * *